US007555809B2

(12) United States Patent
Liu

(10) Patent No.: US 7,555,809 B2
(45) Date of Patent: Jul. 7, 2009

(54) WALL HANGING VACUUM CLEANER

(75) Inventor: Li H. Liu, South Williamsport, PA (US)

(73) Assignee: Shop-Vac Corporation, Williamsport, PA (US)

( * ) Notice: Subject to any disclaimer, the term of this patent is extended or adjusted under 35 U.S.C. 154(b) by 0 days.

(21) Appl. No.: 12/118,044

(22) Filed: May 9, 2008

(65) Prior Publication Data

US 2008/0276411 A1 Nov. 13, 2008

Related U.S. Application Data

(60) Provisional application No. 60/928,852, filed on May 11, 2007, provisional application No. 61/015,305, filed on Dec. 20, 2007.

(51) Int. Cl.
*A47L 5/12* (2006.01)

(52) U.S. Cl. ..... 15/327.5; 15/314; 248/316.2; 248/309.1

(58) Field of Classification Search ..... 15/327.2, 15/327.5, 314; 211/60.1, 65, 88, 87; 403/321, 403/322, 325; 248/316.7, 309.1; *A47L 5/12*
See application file for complete search history.

(56) References Cited

U.S. PATENT DOCUMENTS 4,573,234 A 3/1986 Kochte et al.
4,586,214 A 5/1986 Berfield
4,763,382 A * 8/1988 Sumerau ..... 15/323
5,513,416 A * 5/1996 Bassler et al. ..... 15/323
5,842,254 A * 12/1998 Lee ..... 15/327.4
6,125,498 A 10/2000 Roberts et al.
6,557,206 B1 * 5/2003 Liu ..... 15/327.5

OTHER PUBLICATIONS

European Search Report for European Application No. EP08155840, dated Oct. 1, 2008.

* cited by examiner

*Primary Examiner*—David A Redding
(74) *Attorney, Agent, or Firm*—Marshall, Gerstein & Borun LLP

(57) ABSTRACT

A new vacuum cleaner/bracket combination has a bracket that mates with an indented side on a vacuum cleaner or blower. The indented side has a downwardly-facing upper lip portion and a laterally-facing side lip portion. There is an upper groove portion behind the downwardly-facing upper lip portion, and a side groove portion behind the side lip portion. The bracket has an upper rim portion that is configured to fit within the upper groove portion on the indented side. A side rim portion on the bracket is positioned below the upper rim portion. It is configured to fit within the side groove portion on the indented side when the upper rim portion on the bracket fits within the upper groove portion.

10 Claims, 8 Drawing Sheets

WALL HANGING VACUUM CLEANER

BACKGROUND OF THE INVENTION

The invention described in this document relates generally to pneumatic cleaners (vacuums, blowers, etc.), and more particularly to vacuum cleaners that can be mounted onto a wall bracket.

It is often useful to be able to mount small- and medium-sized vacuum cleaners or blowers to a wall or other surface so that they are out of the way when not in use but are also in a convenient and readily accessible location when needed. Various brackets and shelves have been used in the past. Many prior solutions are imperfect because they are difficult for some consumers to install and may be expensive to manufacture.

BRIEF SUMMARY OF THE DISCLOSURE

The new vacuum cleaner/bracket combination that has been developed includes a bracket that mates with an indented side on a vacuum cleaner or blower. The indented side has a downwardly-facing upper lip portion and a laterally-facing side lip portion. There is an upper groove portion behind the downwardly-facing upper lip portion, and a side groove portion behind the side lip portion.

The bracket has an upper rim portion that is configured to fit within the upper groove portion on the indented side. A side rim portion on the bracket is positioned below the upper rim portion. It is configured to fit within the side groove portion on the indented side when the upper rim portion on the bracket fits within the upper groove portion.

BRIEF DESCRIPTION OF THE DRAWINGS

The invention may be better understood by referring to the accompanying drawings, in which.

DETAILED DESCRIPTION

FIGS. 1-5 depict one embodiment of wall-hanging vacuum cleaner 10 and a wall bracket 16 that use the invention. When the wall bracket is attached to a wall, an indented side on the vacuum cleaner can be used to hang the vacuum cleaner on the bracket, holding it in a convenient storage position.

The indented side and the bracket will be discussed in more detail below. The general arrangement of the vacuum cleaner, apart from the indented side described below, is not important to the way the bracket works.

General Arrangement of the Illustrated Vacuum Cleaner

The invention can be used with many types of vacuum cleaners, including single-piece, handheld vacuums. The illustrated vacuum cleaner 10 has both a vacuum head 12 and a separable vacuum tank 14. The illustrated vacuum head 12 powers the vacuum cleaner, and has a motor and an air impeller (not depicted). The head mounts onto and seals against the vacuum tank 14. The tank holds debris collected by the vacuum cleaner.

The illustrated vacuum tank 14 is manufactured as a single piece of rigid plastic. Single-piece construction can minimize the amount of time and effort to produce the tank. It may also be preferred for making the indented side. However, one-piece construction is not always required. In some circumstances, two-piece tanks or other designs may also be used. Rigid plastic is conducive to true one-piece construction, and may sometimes be preferred for that reason. However, a variety of materials other than rigid plastic can also be used.

Figure 2:
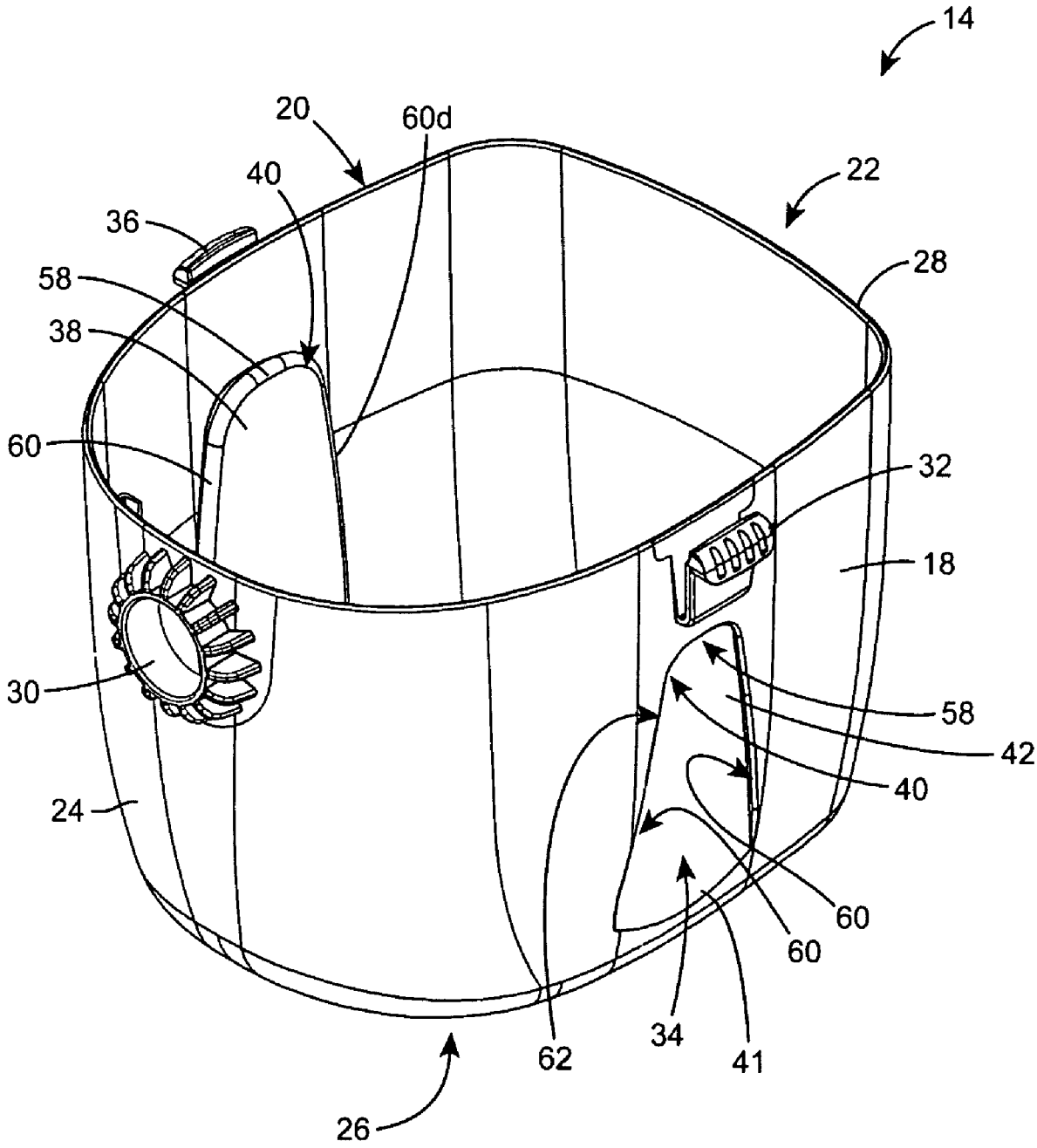
FIG. 2 is an isometric view of the lower portion of the vacuum cleaner seen in FIG. 1.

FIG. 2 shows the tank 14 of the illustrated vacuum cleaner 10 in more detail. For reference, the illustrated tank can be viewed as having a right side 18, a left side 20, a rear side 22, a front side 24, and a bottom 26. A rim 28, an inlet 30, a right latch 32, and a left latch 36 are molded into the illustrated tank.

The rim 28 on the illustrated tank 14 is profiled to correspond with a lip 38 (FIG. 1) on the bottom of the vacuum head 12. The right latch 32 is spaced away from the right side 18 of the tank and the left latch 36 is spaced away from the left side 20. This arrangement provides enough room for the lip of the vacuum head 12 to seal against the rim 28 of the vacuum tank 14 (see FIG. 1).

The inlet 30 is used for attaching a hose to the illustrated vacuum cleaner 10, and may have a conventional design. The illustrated inlet has a reinforced design, and can withstand the forces associated with installing and removing the vacuum hose from the tank 14 during usage.

The Indented Sides

The right and left sides 18 and 20 of the illustrated vacuum cleaner 10 each have an indentation 40 that can be used for mounting the vacuum cleaner to the illustrated wall bracket 16. The indentation could also be on other sides of the tank 14, or on other parts of the vacuum cleaner, such as a side on the illustrated vacuum head 12. While two indentations are shown in this example, only one indentation may be needed.

In general, a lower portion 41 of the illustrated indentation 40 is nearly flush with the side 18 of the vacuum cleaner 10. An upper portion 42 of the indentation has a downwardly-facing upper lip portion 58 and two opposed laterally-facing side lip portions 60. An upper groove portion 46 can be found behind the upper lip portion, and a side groove portion 48 (FIG. 1) can be found behind each side lip portion. The outer end of the groove portions (the back wall of the lip portions) is angled.

For manufacturing ease, the side lip portions 60, the upper lip portion 58, and adjacent portions of the illustrated vacuum cleaner 10 are all part of an integral molding. This is not always required.

Figure 1:
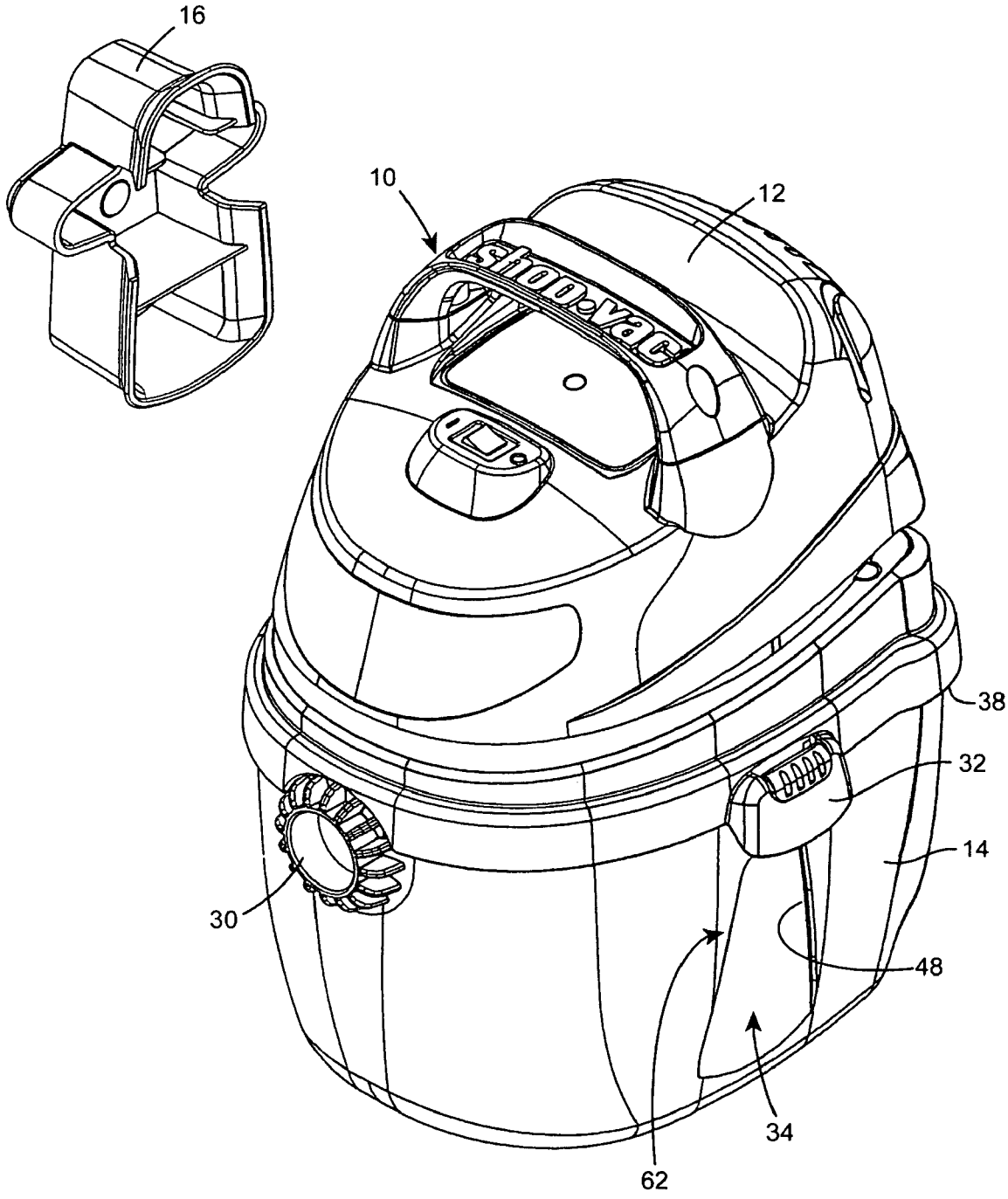
FIG. 1 is an isometric view of one embodiment of a wall-hanging vacuum cleaner and associated wall bracket.

In this example, the lip portions 58, 60 form a continuous lip that has a three-sided shape seen in FIG. 1, with the side lip portions 60 being relatively linear and sloped so that the tops of the side lip portions are spaced closer together than the bottoms of the side lip portions. As explained below, the taper resulting from this arrangement (where the side lip portions ascend toward each other) may facilitate the mounting of the vacuum cleaner 10 onto the wall bracket 16. However, in some circumstances, this taper may not be required.

Similarly, this example shows edges of the side lip portions 60 extending toward each other; in other words, there is an empty space in front of the vacuum cleaner 10 between the right edge of the left side lip portion and the left edge of the right side lip portion. In some circumstances, the edges of the side lip portions could be arranged to extend away from each other, so that the right side of the left side lip and the left side of the right side lip are the sides that transition into the rest of the vacuum cleaner 10.

In this example, the side lip portions 60 both extend down several inches from the lateral ends of the upper lip portion 58. This downward extension helps to provide lateral stability to the vacuum cleaner 10 while it is hung from the bracket 16, and will be discussed in more detail below. In this example, the side lip portions extend almost to the bottom of the vacuum cleaner. Other arrangements are possible.

The Bracket

The wall bracket 16 holds the vacuum cleaner 10. Specifically, the bracket is shaped to mate with one of the indentations 40 on the sides 18, 20 of the vacuum cleaner. The bracket may be molded in one piece of rigid plastic, or in some other suitable material. Again, however, neither one-piece construction nor the use of rigid plastic is required. Many alternatives are possible, including, for example, the use of steel or aluminum.

Figure 3A:
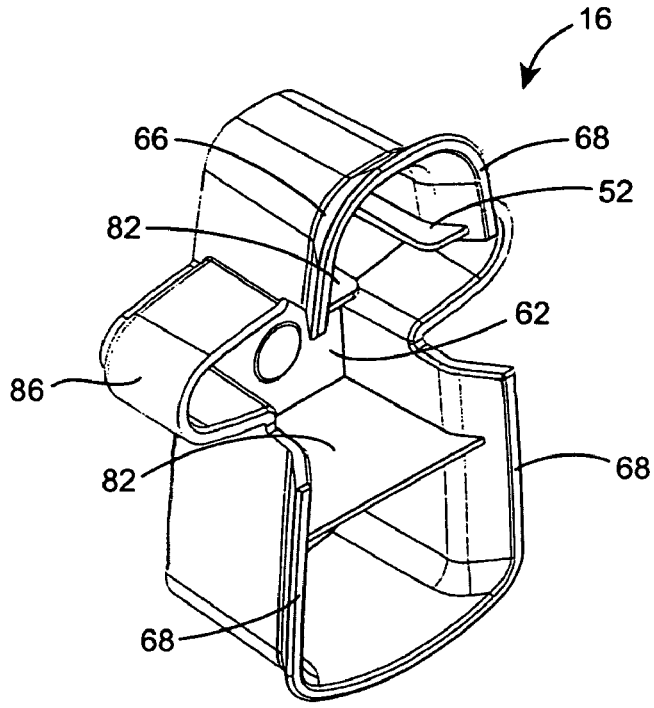
FIG. 3*a* is an isometric view of the wall bracket seen in FIG. 1.
Figure 3B:
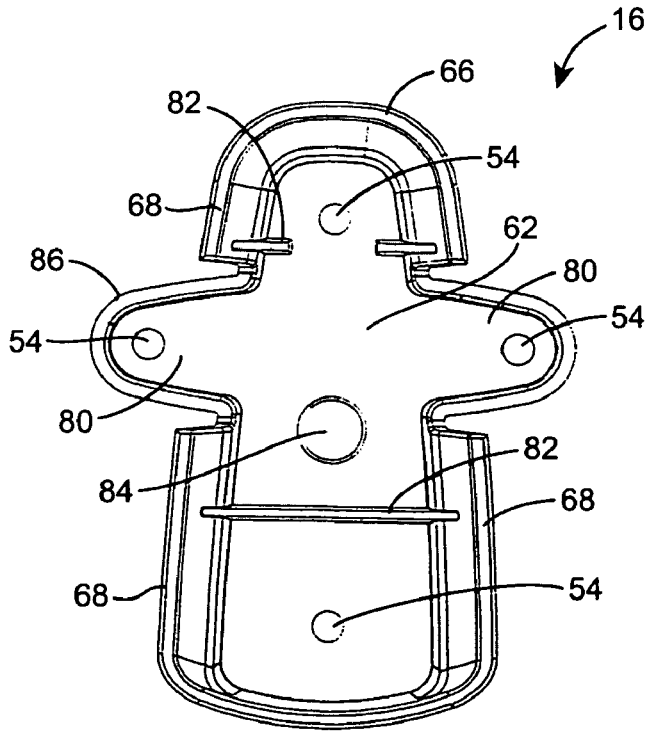
FIG. 3*b* is a plan view of the wall bracket seen in FIG. 1.
Figure 4:
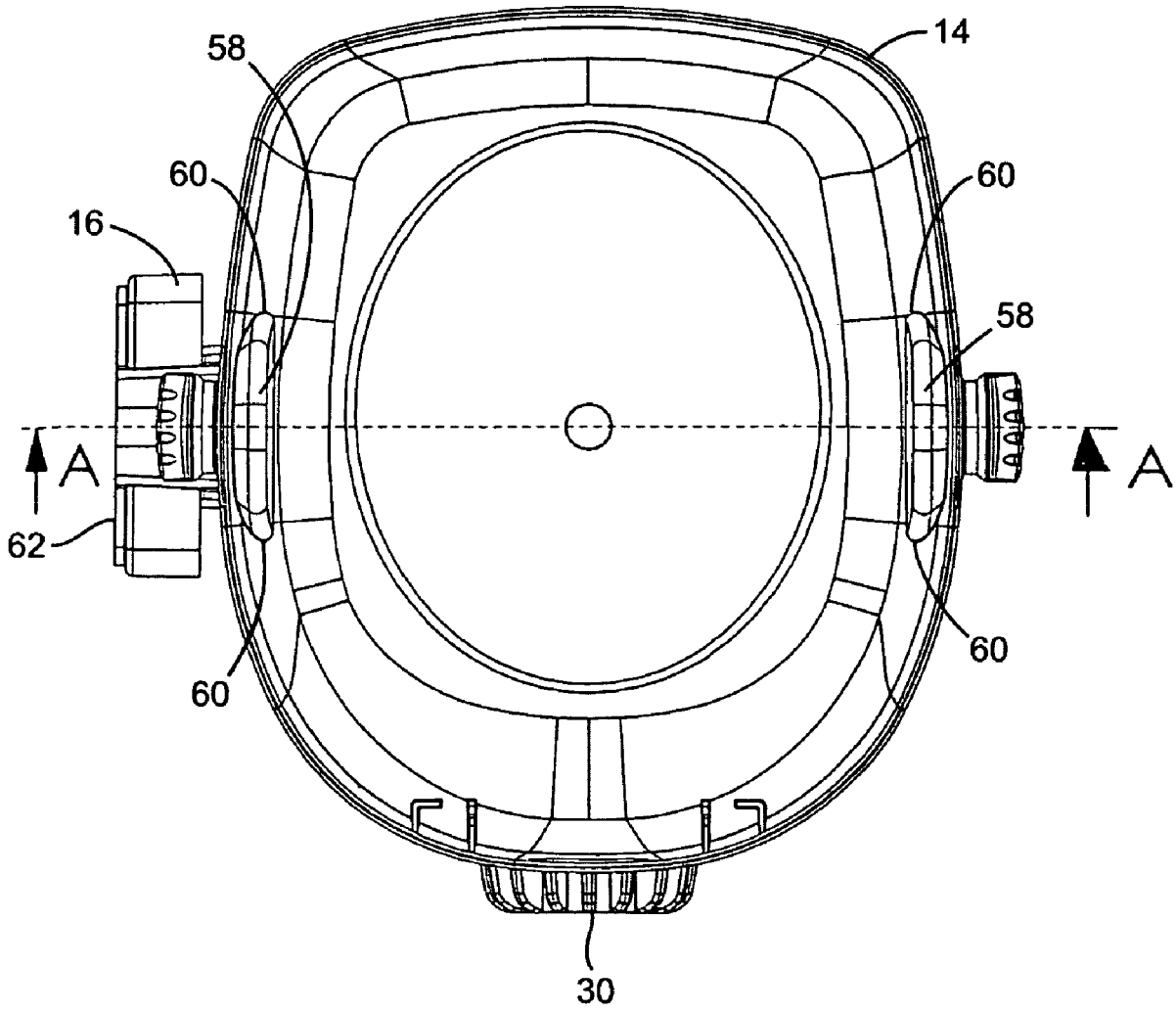
FIG. 4 is a plan view of the portion of the vacuum cleaner seen in FIG. 2 mounted onto the wall bracket seen in FIG. 3.
Figure 5A:
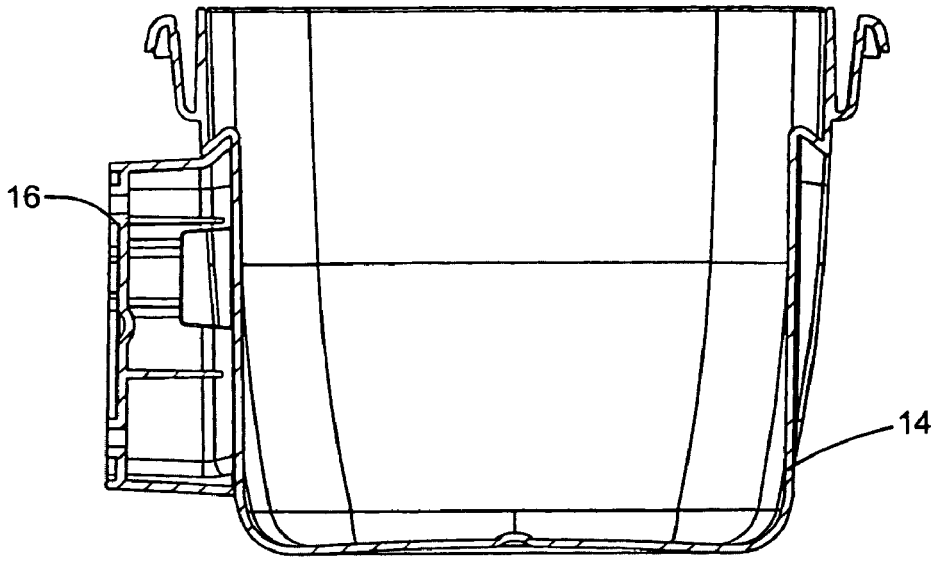
FIG. 5*a* is a sectional view through lines A-A in FIG. 4.
Figure 5B:
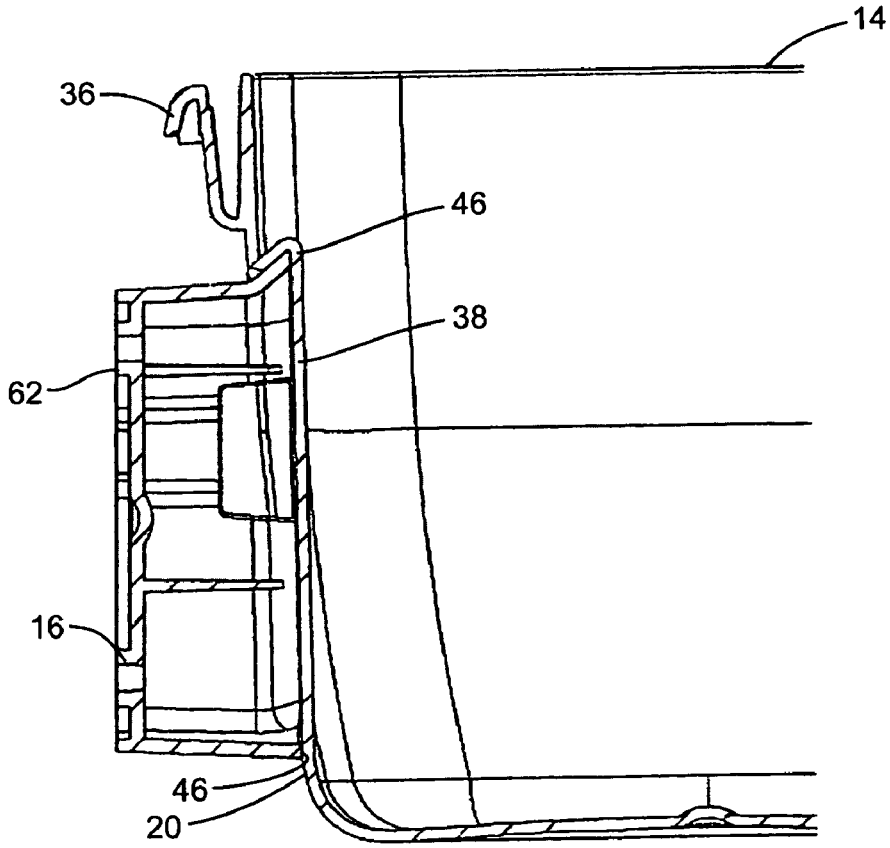
FIG. 5*b* is a close-up view of the portion of the combination seen in FIG. 5*a*.

The bracket 16 seen in FIG. 3 can be mounted to a wall by placing a base 62 of the bracket against the wall and then driving screws or nails through openings 54 in the base and then into the wall. Variations, such as the use of adhesives, are possible. The wide spacing of the openings 54 on the illustrated bracket helps stabilize the bracket on the wall.

The slope of the illustrated side rim portions 68 on the bracket 16 and of the illustrated side lip portions 60 on the vacuum cleaner allow the components to carry at least some of the weight of the vacuum cleaner. Thus, portions of these elements could serve as upper lip portions or upper rim portions.

The illustrated bracket 16 has an upper rim portion 66 that carries at least a portion of the weight of the vacuum cleaner 10. To do this, the upper rim portion is configured to fit within the upper groove portion 46 on the side of the vacuum cleaner. The upper rim of the illustrated bracket extends upwardly and forwardly from the base 62 of the bracket, and has a sloped rear face. The lateral spacing between the back of the base of the bracket and the uppermost edge of the upper rim portion of the bracket is greater than the thickness of the upper lip portion 58 on the vacuum cleaner, and the lateral spacing between the lowermost edge of the upper lip portion of the vacuum cleaner and the side of the vacuum cleaner (i.e., the width of the upper groove portion 46) is greater than the thickness of the upper rim portion of the bracket.

Side rim portions 68 on the illustrated bracket 16 help to provide lateral stability to the mounted vacuum cleaner 10. To provide this stability, the side rim portions are configured to fit within the side groove portions 48 on the vacuum cleaner 10. The side rim portions of the illustrated bracket extend laterally (in opposed directions) and are positioned forwardly from the back of the base 62 of the bracket. The lateral spacing between the back of the base of the bracket and the outermost edge of the side rim portions of the bracket is greater than the thickness of the side lip portions 60 of the vacuum cleaner, and the lateral spacing between the edges of the side lip portions and the side of the vacuum cleaner (i.e., the width of the side groove portions 48) is greater than the thickness of the side rim portions of the bracket.

The lowermost side rim portions 68 of the bracket 16 seen in FIG. 3 are disposed several inches below the upper rim portion 66 of the bracket. With this spacing, the side rim portions of the bracket engage within the side groove portions 48 on the vacuum cleaner 10 when the upper rim portion of the bracket is engaged in the upper groove portion 46 behind the upper lip portion 58 of the indentation 40 on the vacuum cleaner.

Although it is not always necessary, the laterally-facing side rim portions 68 of the illustrated bracket 16 ascend toward each other; i.e., the upper portions of the side rim portions are closer together than the lower portions are. When combined with the side rim portions extending away from each other, this configuration helps to provide a gradual locking of the illustrated vacuum cleaner 10 onto the bracket as the vacuum cleaner is lowered onto the bracket. A gradual locking is also aided by the sloping back surfaces of the groove portions 46, 48 of the indentation 40 and of the rim portions on the bracket. As the rim and lip portions engage further, the sloping back surfaces slide together, creating a tighter fit.

Figure 6:
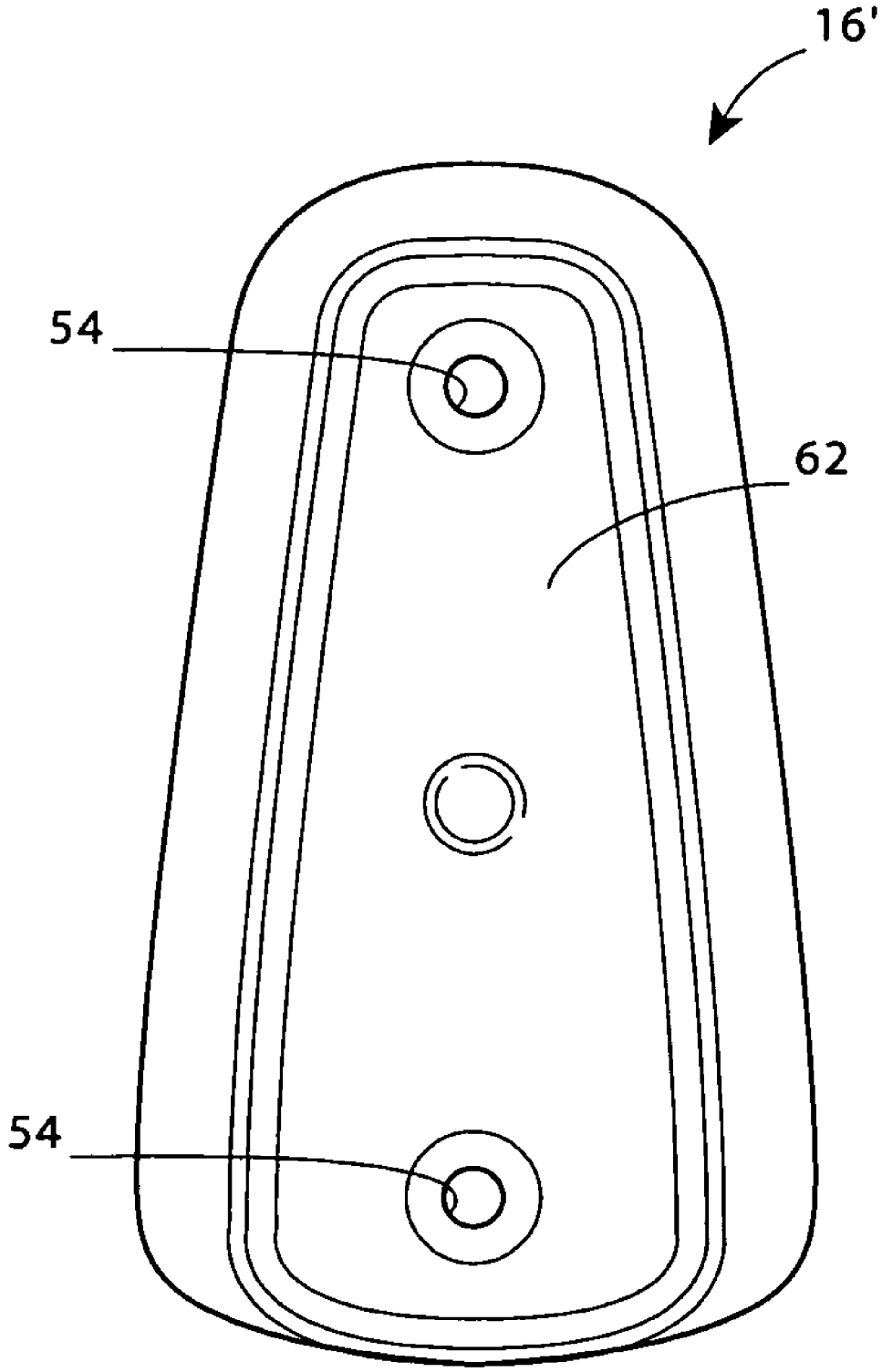
FIG. 6 is a rear plan view of an alternative embodiment of a bracket that can be used with vacuum cleaner seen in FIG. 1.
Figure 7:
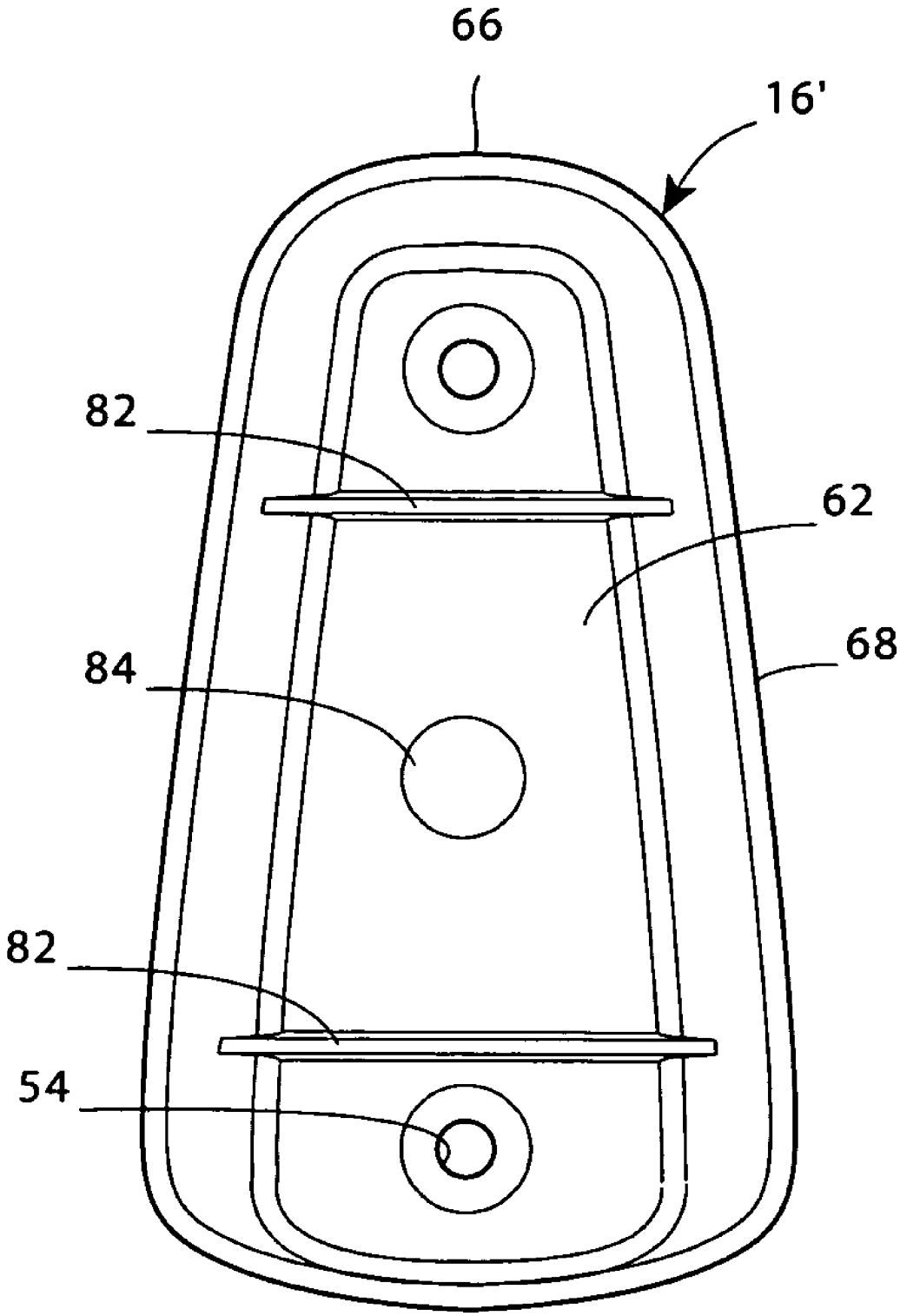
FIG. 7 is a front plan view of the bracket seen in FIG. 6.
Figure 8:
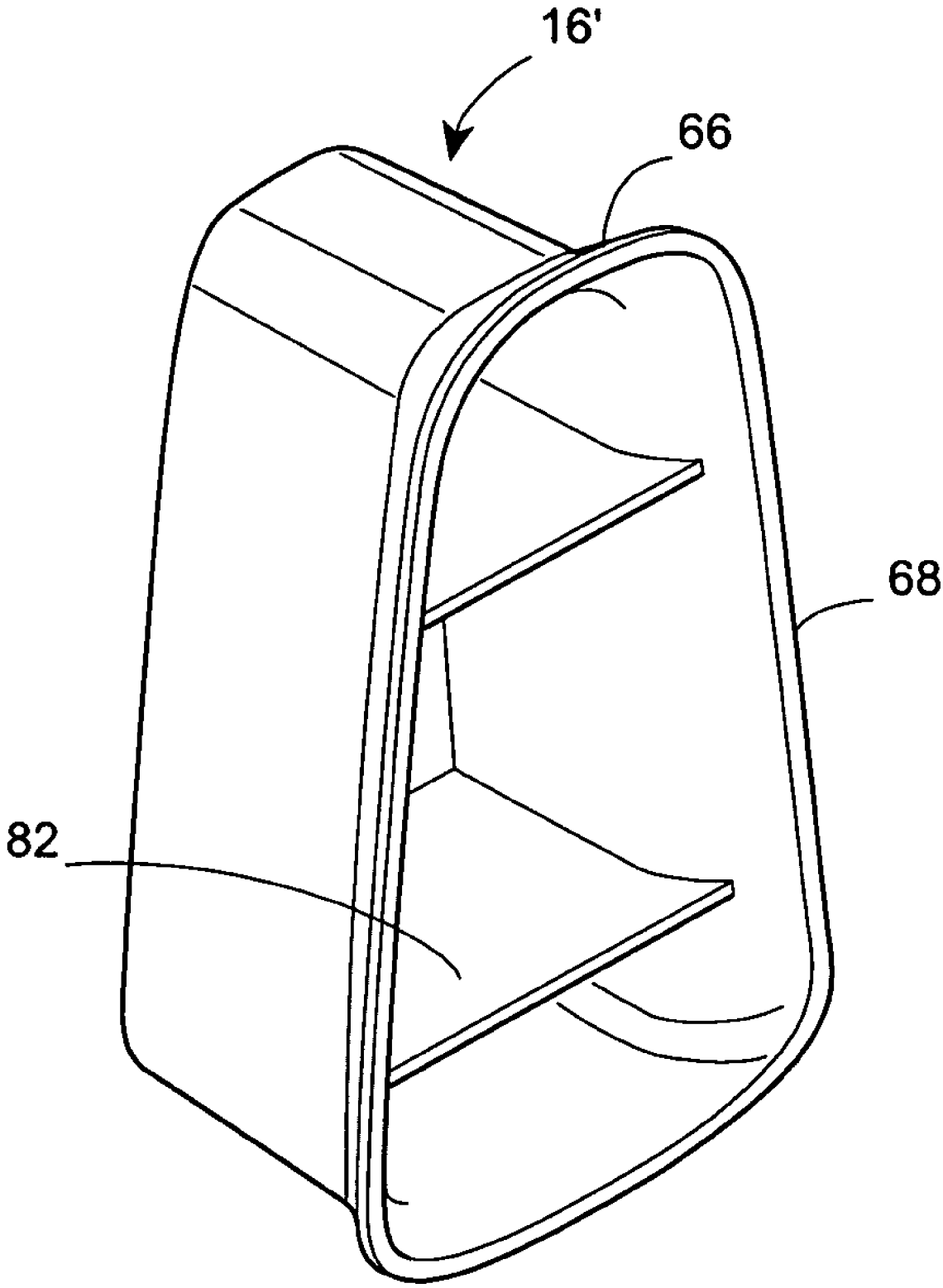
FIG. 8 is a perspective view of the bracket seen in FIG. 6.

In the alternative embodiment of a bracket seen in FIGS. 6-8, the side rim portions 68 of the bracket 16' extend down continuously from the lateral ends of the upper rim portion 66, so that the rim on the bracket flows continuously from one side rim portion into the upper rim portion and then on into the opposed side rim portion. Although this arrangement may sometimes be preferred, it is not always required.

In both illustrated examples of suitable brackets, the side rim portions 68, the upper rim portion 66, and surrounding portions of the bracket are all part of an integral molding. This arrangement can simplify molding and improve efficiency.

In these examples, both lateral sides of the base 62 of the bracket 16 taper toward the center line of the bracket as they progress upwardly. In other circumstances, it might be possible for one lateral side or the other to taper away from the center line, so long as the distance between the two lateral sides is no greater at the top of the bracket than it is at the bottom.

The bracket 16 seen in FIG. 3 has optional arms 80, several structural reinforcements 82, and a molding knob 84 that may facilitate molding of the illustrated bracket. The two arms extend outwardly from sloping lateral sides of the base, permitting the mounting apertures to be set relatively far from the center line of the bracket. Placing holes far from the centerline can provide more stability for the mounted bracket, and can otherwise facilitate the mounting of the bracket on a wall. The illustrated optional arms are strengthened by projecting collars 86. In this example, the collars extend away from the base, but stop short of the outwardly-splaying rim portions 68.

Hanging the Vacuum Cleaner on the Bracket

To mount the illustrated vacuum cleaner 10 onto the illustrated bracket 16, the vacuum cleaner 14 is first positioned with the upper rim portion 66 of the bracket 16 between the top and the bottom of one of the indentations 40 on the side of the vacuum cleaner. In this position, the upper rim portion of the bracket fits between the side lip portions 60 on the vacuum cleaner. The vacuum cleaner can then be lowered, moving the lip portions 58, 60 of the vacuum cleaner behind the rim portions 66, 68 on the bracket until the upper rim portion 66 stops and locks into the upper groove portion 46 on the vacuum cleaner, and the upper lip portion 58 on the vacuum cleaner rests against the upper rim portion 66 of the bracket. As the vacuum cleaner is lowered, the side rim portions 68 of the bracket 16 slide into the side groove portions 48 of the vacuum cleaner, with the slope of the back sides causing the fit to progressively tighten. This provides good lateral support.

In this case, the taper of the side groove portions 48 on the indentation 40 and the taper of the side rim portions 68 of the bracket 16 both help to direct the wall bracket into the indentation so that it seats properly, and provide additional security. In other embodiments, one or the other of these components, or both, might not be tapered.

When the illustrated vacuum cleaner 10 is mounted on either of the illustrated brackets 16, 16', it is in an inherently stable and secure position. The vacuum cleaner can be removed by lifting it upwardly to disengage the rim portions 66, 68 from the groove portions 46, 48 of the indentation 40.

This description of various embodiments of the invention has been provided for illustrative purposes. Revisions or modifications may be apparent to those of ordinary skill in the art without departing from the invention. The full scope of the invention is set forth in the following claims.

What is claimed is:

1. A vacuum cleaner and bracket combination that has:

a vacuum cleaner;

a side on the vacuum cleaner;

a downwardly-facing upper lip portion on the side;

an upper groove portion behind the downwardly-facing upper lip portion;

a laterally-facing side lip portion that is on the side and is positioned below the upper lip portion;

a side groove portion behind the side lip portion;

a wall-mountable bracket;

an upper rim portion on the bracket that is configured to fit within the upper groove portion on the side of the vacuum; and a side rim portion on the bracket that is positioned and configured to fit within the side groove portion on the side of the vacuum cleaner when the upper rim portion on the bracket fits within the upper groove portion on the vacuum cleaner.

2. A vacuum cleaner and bracket combination as recited in claim 1, in which:

the side on the vacuum cleaner has a second laterally-facing side lip portion that opposes the first laterally-facing side lip portion; and the side has a second side groove portion behind the second side lip portion.

3. A vacuum cleaner and bracket combination as recited in claim 1, in which:

the vacuum cleaner has two opposed laterally-facing side lip portions.

4. A vacuum cleaner and bracket combination as recited in claim 1, in which:

the vacuum cleaner has two opposed laterally-facing side lip portions that ascend toward each other.

5. A vacuum cleaner and bracket combination as recited in claim 1, in which:

the vacuum cleaner has two opposed laterally-facing side lip portions that extend toward each other.

6. A vacuum cleaner and bracket combination as recited in claim 1, in which:

the vacuum cleaner has two opposed laterally-facing side lip portions; and the side lip portions, the upper lip portion, and surrounding portions of the side are all part of an integral molding.

7. A vacuum cleaner and bracket combination as recited in claim 1, in which:

the bracket has two opposed laterally-facing side rim portions.

8. A vacuum cleaner and bracket combination as recited in claim 1, in which:

the bracket has two opposed laterally-facing side rim portions that ascend toward each other.

9. A vacuum cleaner and bracket combination as recited in claim 1, in which:

the bracket has two opposed laterally-facing side rim portions that extend away from each other.

10. A vacuum cleaner and bracket combination as recited in claim 1, in which:

the bracket has two opposed side lip portions; and the side lip portions, the upper lip portion, and surrounding portions of the bracket are all part of an integral molding.

* * * * *